US006898871B2

(12) United States Patent
Herman

(10) Patent No.: US 6,898,871 B2
(45) Date of Patent: May 31, 2005

(54) SHOCK-ABSORBING DEVICE FOR FOOTWEAR

(75) Inventor: Maria Laura Herman, Santiago (CL)

(73) Assignee: Gacel S.A., Santiago (CL)

( * ) Notice: Subject to any disclaimer, the term of this patent is extended or adjusted under 35 U.S.C. 154(b) by 0 days.

(21) Appl. No.: 10/604,678

(22) Filed: Aug. 8, 2003

(65) Prior Publication Data

US 2004/0237343 A1 Dec. 2, 2004

(51) Int. Cl.[7] ..... A43B 13/18
(52) U.S. Cl. ..... 36/28; 36/141
(58) Field of Search ..... 36/141, 28, 59 R, 36/8.1

(56) References Cited

U.S. PATENT DOCUMENTS

| | | | | |
|---|---|---|---|---|
| 3,722,113 A | | 3/1973 | Birkenstock | |
| 3,757,774 A | * | 9/1973 | Hatuno | 601/28 |
| 4,075,772 A | * | 2/1978 | Sicurella | 36/43 |
| 5,371,958 A | * | 12/1994 | Brosseau | 36/8.1 |
| 5,839,208 A | * | 11/1998 | Huang | 36/28 |
| 6,131,310 A | * | 10/2000 | Fang | 36/28 |
| 6,209,226 B1 | * | 4/2001 | Squadroni | 36/3 B |
| 2001/0003229 A1 | * | 6/2001 | Zocca | 36/3 B |
| 2001/0045028 A1 | * | 11/2001 | Crane et al. | 36/44 |
| 2002/0088140 A1 | * | 7/2002 | Wang et al. | 36/3 B |

FOREIGN PATENT DOCUMENTS

| | | | |
|---|---|---|---|
| EP | 578618 | * | 1/1994 |

* cited by examiner

*Primary Examiner*—M. D. Patterson
(74) *Attorney, Agent, or Firm*—Daniel F. Nesbitt; Hasse & Nesbitt LLC

(57) ABSTRACT

A shock-absorbing system and device for footwear, and a footwear article including the device. The shock-absorbing device has a plurality of first projections distributed on and extending upwardly from the upper surface in contact with the user's foot, and a plurality of second projections distributed on and extending downwardly from the lower surface in contact with the ground. During the flexion of the foot when stepping, the second projections yield elastically, and displace the first projections upwards and into contact with the foot. The first projections move in a plurality of directions, achieving a massage action, the shock-absorbing, and the uniform distribution of the load on the foot.

20 Claims, 6 Drawing Sheets

SHOCK-ABSORBING DEVICE FOR FOOTWEAR

BACKGROUND OF INVENTION

The present invention generally refers to footwear, and to a shock-absorbing system and device for footwear.

Under certain situations or working conditions, a person is compelled to be in continuous movement during many hours of the day, and in some cases, is more or less motionless. Since the comfort of the feet is more important, it is necessary to develop solutions including elastic suspension systems as well as footwear which provide greater comfort to the user.

For many years, shoe sole constructions have been developed that are capable of massaging the whole sole of the foot, since they are provided with cylindrical projections comprising rounded tips of the same or different heights, creating a resting surface according to anatomic requisites. It has been found, however, that in spite of the efforts that have been made up to date, neither a uniform massage along the whole sole area of the foot nor a satisfactory support, which is suitable for the lower portion of the foot, have been obtained.

U.S. Pat. No. 3,722,113, issued on Mar. 27, 1973 to K. Birkenstock, describes an article of footwear having uppers which may be in the form of straps, and a sole of yieldable elastomeric material. The article of footwear comprises on its lower surface projections which extend in a substantially perpendicular direction to the general plane of the respective surface of the article. The projections may be of different lengths.

Furthermore, the solution proposed in the patent document ES 2,116,430, belonging to the company Menghi Shoes—S.r.L of Italy, deals with a shoe sole, produced by means of molding, comprising a set of projections suitable for providing a massage to the sole of foot.

The above-mentioned solutions do not achieve the desired shock-absorbing, supporting and massaging action, since the projections suitable to support the foot do not have a design which allows to soften the pressure exerted by the foot over the displacement surface or the ground, nor a suitable height, nor the necessary arrangement to allow the foot-exerted pressure to be effectively distributed, but rather concentrates it only in local points without achieving a uniform distribution thereof.

It is important to emphasize that a suitable massage action is produced when a constant change of the surface portions of the human anatomy is present, in this case in the foot subjected to the massage.

SUMMARY OF INVENTION

The present invention relates to a shock-absorbing device for use in footwear, comprising 1) a base having an upper surface adapted to confront the bottom surface of a user's foot, and a lower surface adapted to contact a walking surface, 2) a plurality of first projections distributed on and projecting upward from the upper surface, and projecting in a normal direction to the bottom surface of the foot, and 3) a plurality of second projections distributed on and projecting downward from the lower surface; wherein the device provides a shock-absorbing system that is activated by the pressure exerted by foot flexion during walking on a walking surface, whereby the first projections are pressed in contact with the bottom of the foot.

The present invention also relates to a shock-absorbing system for footwear, comprising a) a plurality of first projections distributed on and projecting upwardly from an upper surface, and in contact with and extending substantially in the normal direction to the bottom surface of a user's foot, and 2) a plurality of second projections distributed on and projecting downwardly from a lower surface, and in contact with a walking surface, the second projections having a shape, and a circumferential recess, wherein the system is activated by pressure exerted on the second projections that, on foot flexion during stepping on the walking surface, cause the second projections to yield elastically and to displace and press the first projections into contact with the bottom of the user's foot, thereby achieving a massage action, the shock-absorbing, and the uniform distribution of weight on the foot.

The present invention also relates to a footwear article, comprising: a). a shock-absorbing device for use in footwear, comprising: 1) a base having an upper surface adapted to confront the bottom surface of a user's foot, and a lower surface adapted to contact a walking surface, 2) a plurality of first projections distributed on and projecting upward from the upper surface, and projecting in a normal direction to the bottom surface of the foot, and 3) a plurality of second projections distributed on and projecting downward from the lower surface; wherein the device provides a shock-absorbing system that is activated by the pressure exerted by foot flexion during walking on a walking surface, whereby the first projections are pressed in contact with the bottom of the foot; and b) a shoe upper.

DETAILED DESCRIPTION

The present invention provides an improved shock-absorbing system for use in footwear, which provides a uniform shock-absorbing and supporting action, and a massage effect for the user's foot.

Figure 1:
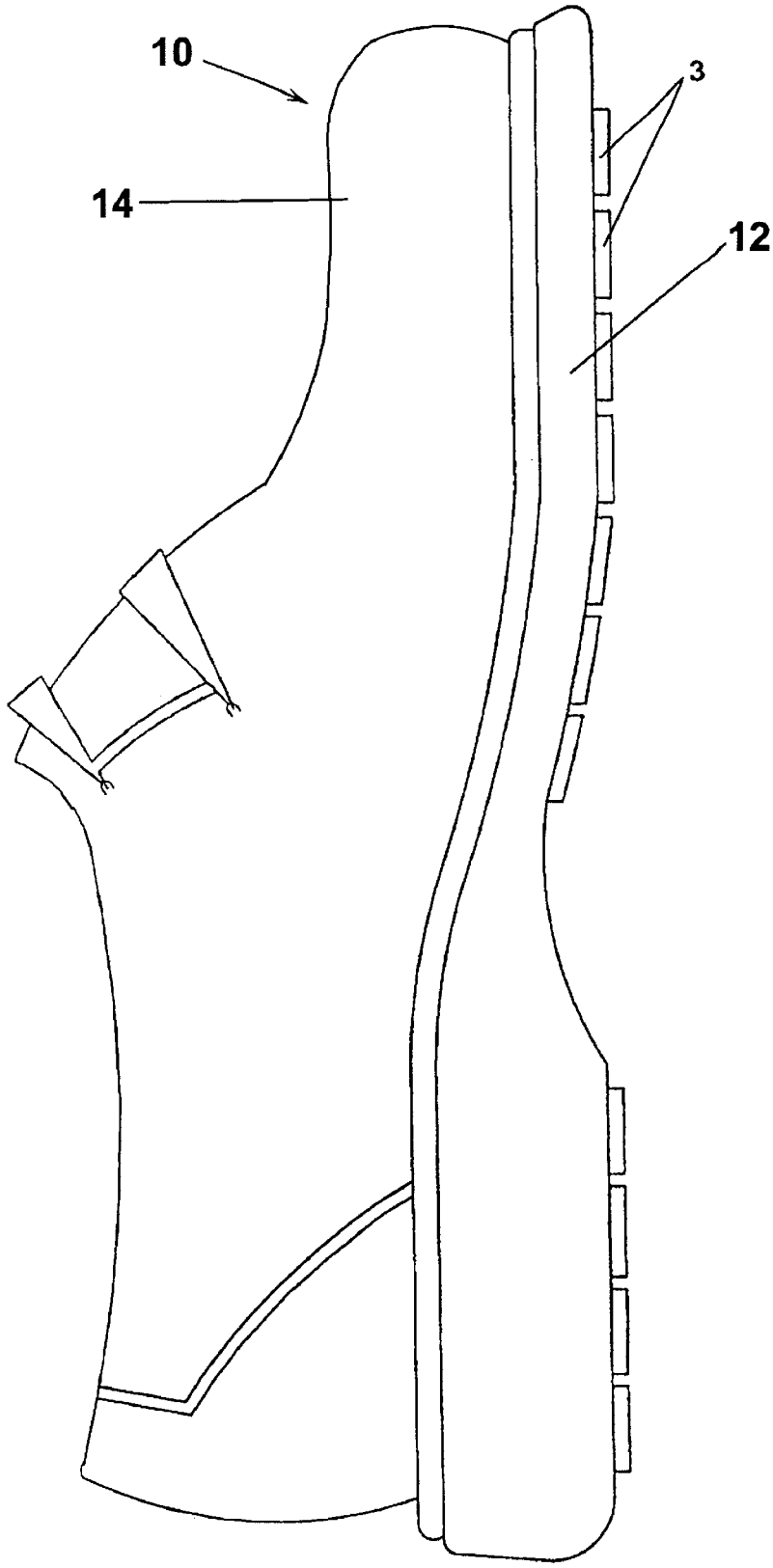
FIG. 1 shows a footwear article of the present invention having a shock-absorbing device.

As shown in FIG. 1, the instant invention also provides an improved footwear article 10 having a shoe upper portion 14 and a shock-absorbing device 12, the production and sales price of which are relatively economical.

The present invention also relates to a shock-absorbing system that comprises an upper means adapted to confront the bottom surface of the user's foot, and an opposed lower means adapted to contact with a walking surface. The shock-absorbing system can be embodied in a shock-absorbing device 12 that comprises a base 16 having an upper surface 18, shown in FIG. 2, that confronts the user's foot (not shown), and a lower surface 20, shown in FIG. 3, that confronts the walking surface (not shown). The device 12 comprises a plurality of first projections 22 distributed on and projecting from the upper surface 18 facing the user's foot, extending substantially in a direction normal or perpendicular to the bottom surface of the user's foot. The system is activated by the pressure exerted on a plurality of second projections 24 provided on and projecting downward from the lower surface 20 that contacts with the ground. These second projections 24 typically have the same geometric shape and size within an embodiment, as shown in the embodiment shown in FIG. 3, though they can have a different geometric shape and cross sectional size from one embodiment to another. Each projection 24 comprises a circumferential recess 30 that permits elastic movement between the base 16 and the lower projection 24 in response to an upward displacement of the second projection 24. The first or upper projections 22 mechanically communicate with the second or lower projections 24 through the common base 16. When the flexion of the foot is produced during the displacement on the walking surface or ground, the upper displacement of the second projections 24 press the distributed first projections 22 on the upper surface 18 into contact with the bottom of the user's foot. The first projections 22 displace in a plurality of directions, and typically all directions, thus achieving the massage effect, the shock-absorbing effect and the uniform distribution of the weight on the foot.

The invention further relates to a footwear article 10 that comprises the shock-absorbing system of the invention incorporated into a footwear upper 14. An embodiment of the footwear article comprises the shock-absorbing device 12 and the footwear upper 14. The footwear article can comprise a shoe, a slipper, a sandal, or any other article worn on the foot.

Figure 4:
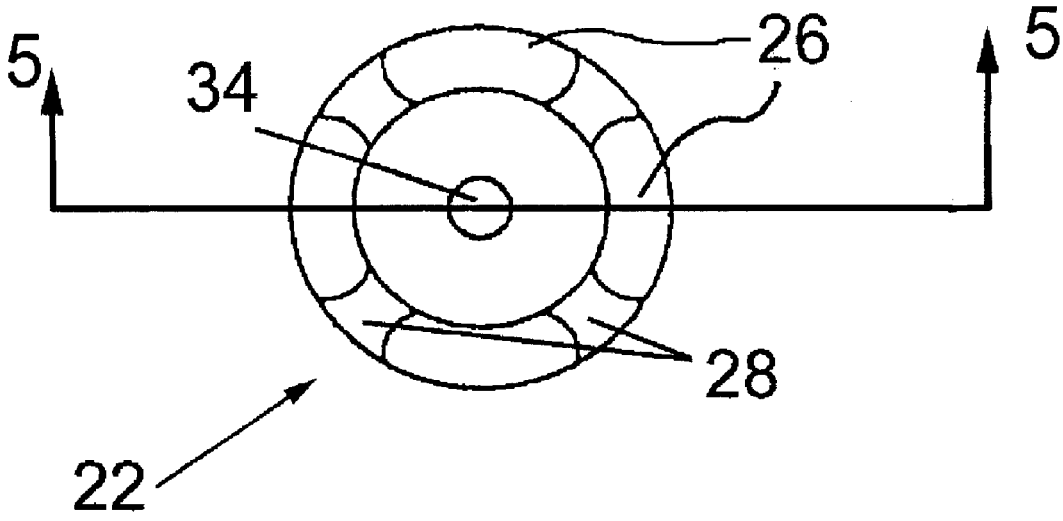
FIG. 4 shows a partial plan view of a first projection shown in FIG. 2, having raised members that contact the bottom surface of the user's foot.
Figure 5:
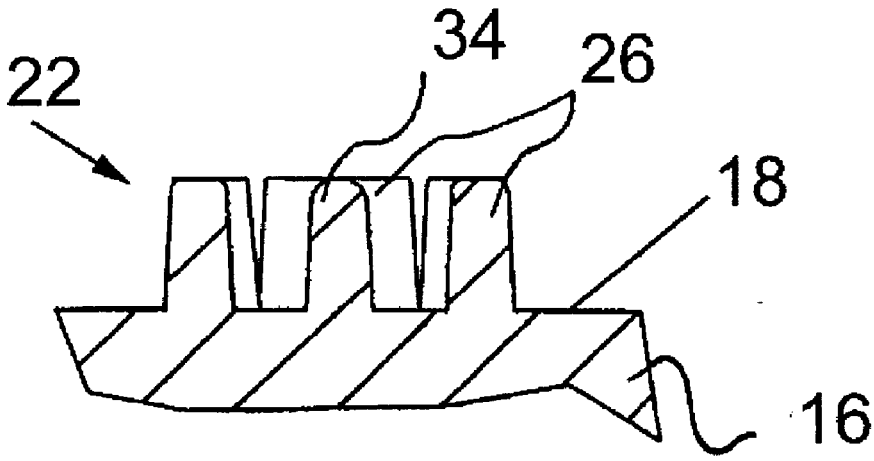
FIG. 5 shows a cross sectional view of the first projection as viewed through line 5—5 of FIG. 4.
Figure 6:
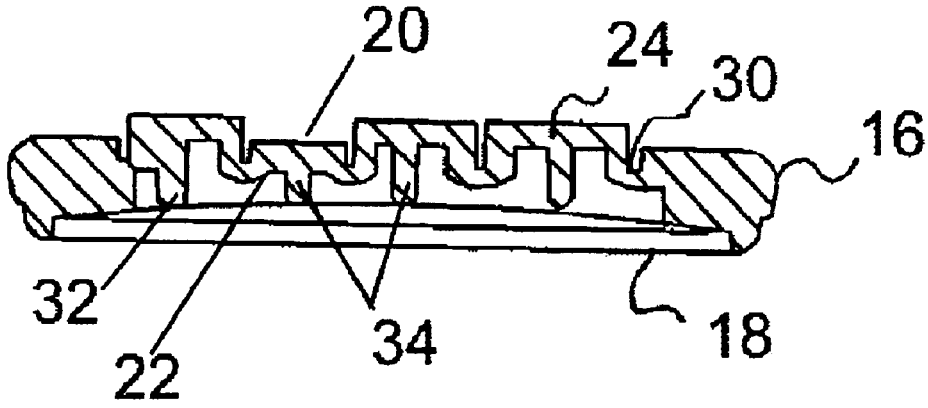
FIG. 6 shows a lateral sectional view of the front end of the shock-absorbing device as viewed through line 6—6 of FIG. 3, illustrating the first projections and the second projections.
Figure 7:
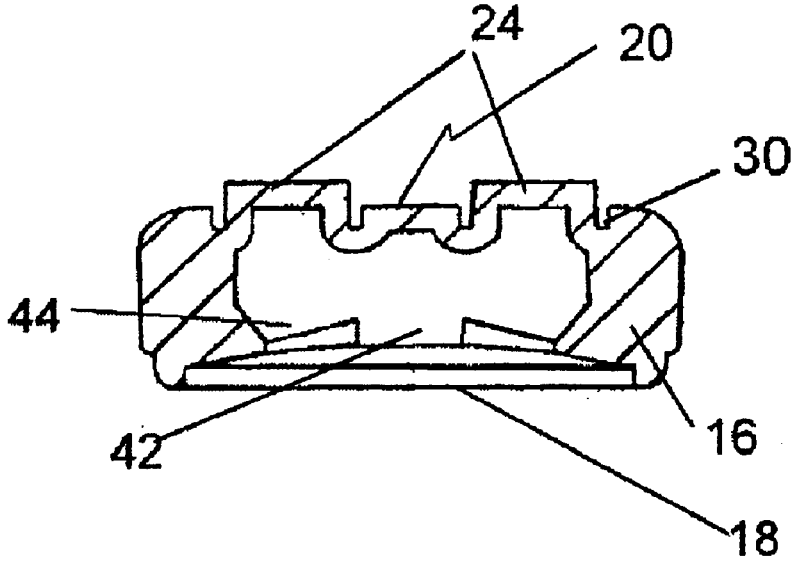
FIG. 7 shows a lateral, sectional view of the heel end of the upper surface shock-absorbing device as viewed through line 7—7 of FIG. 3.
Figure 8:
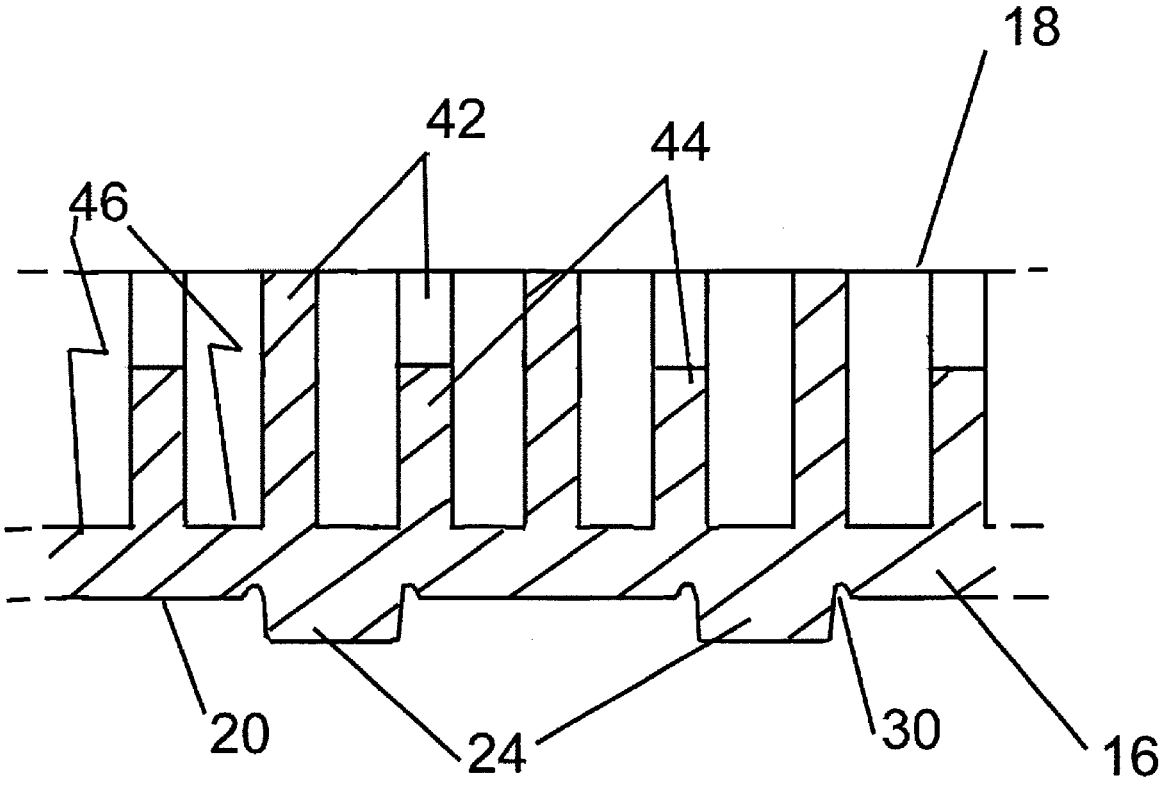
FIG. 8 shows a longitudinal, sectional view of the heel end of the shock-absorbing device as viewed through line 8—8 of FIG. 2.

In an embodiment of the present invention, the first or upper projections 22 can comprise a ring of four raised members 26, separated by four recesses 28, as shown in FIG. 4. The first projection 22 also comprises a central pin 34.

Amongst the plurality of first circumferential projections 22 are positioned, in a random manner, a plurality of, and in a particular embodiment, approximately seventy-five pivots 32 that increase the massage action.

Figure 3:
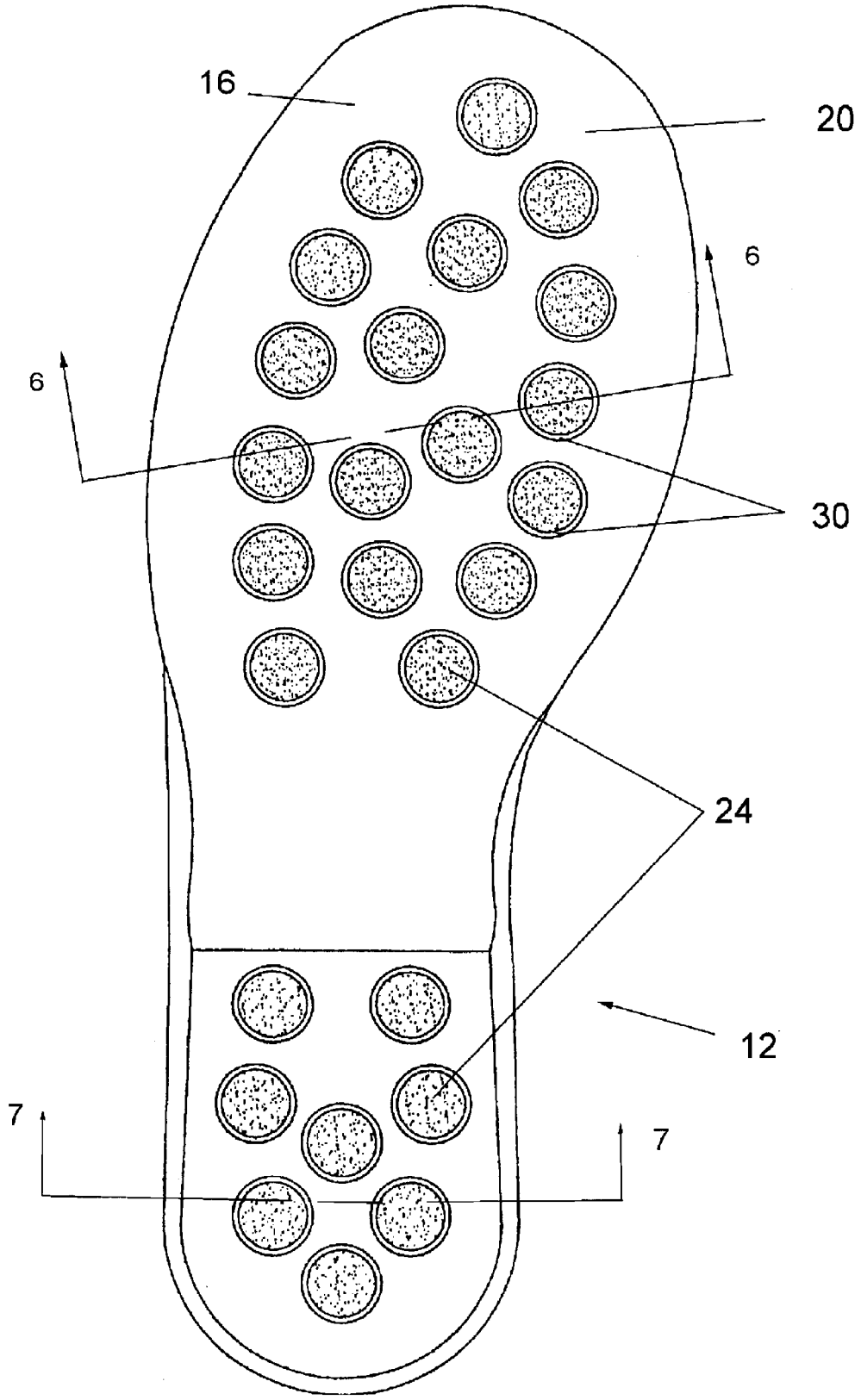
FIG. 3 shows a plan view of the lower surface of the shock-absorbing device of the invention that is in contact with a walking surface, having a plurality of second projections thereon.

In FIG. 3, the second projections 24 are shown as circular projections of the same size.

On the heel end of the footwear article, the shock-absorbing action is produced by a plurality of laterally-aligned elements, shown as a plurality of shorter upright wave-like walls 44 and a as a plurality of taller upright wave-like walls 42. By laterally-aligned means a direction between one side to the other side of the foot. The upright wave-like walls 42 and 44 are arranged in a plurality of laterally-aligned rows, with the shorter and taller walls members alternating in order, and channels 46 are alternately and confronting one another in a longitudinal direction. The rows of walls are separated in the longitudinal direction by a plurality of channels 46. The construction allows the flexion and torsion of the foot in the heel portion, following the shape of the walking surface or supporting ground. The laterally-aligned rows of wall elements are separated by a distance of typically about 6 mm. The wave-like wall elements 42 and 44 become compressed as a reaction to the foot torsion produced during walking, allowing thereby the flexibility of the foot.

The shock-absorbing system and device 12 of the invention are not limited to an exact number of either first or second projections 22 and 24, respectively. The number of the projections used basically depends on the footwear size. In the embodiment shown in FIG. 3 the lower, front end of the device 12 (where the ball of the user's foot is positioned) has eighteen of the second projections 24, while there are eight in the heel end.

Figure 2:
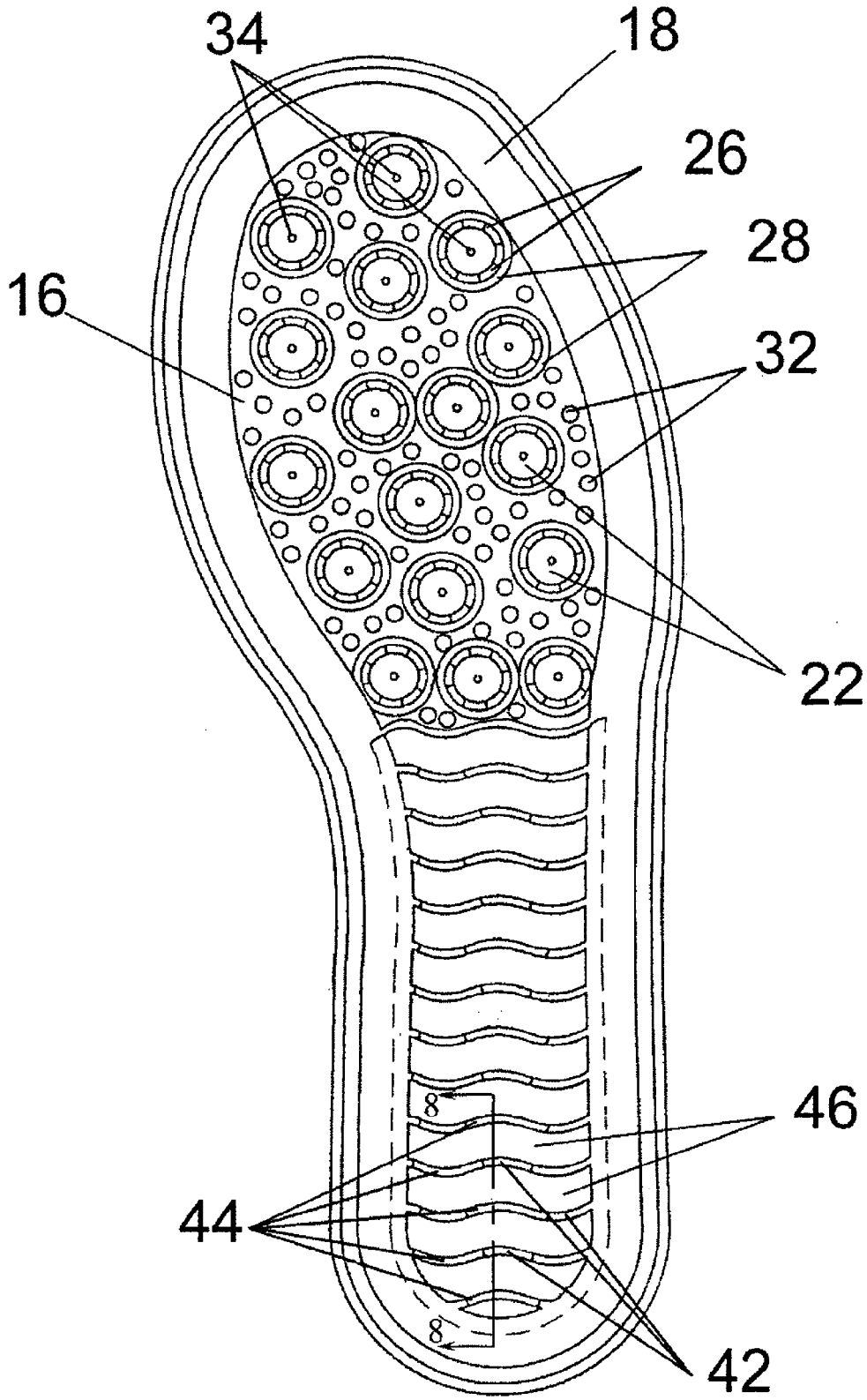
FIG. 2 shows a plan view of the upper surface of the shock-absorbing device of the invention that is in contact with the bottom surface of the user's foot, having a plurality of first projections thereon.

An embodiment of the shock-absorbing device 12 typically comprises seventeen to twenty-one of the first circular projections 22 on the upper surface 18. As illustrated in the embodiment of FIG. 2, each projection 22 can comprise four raised members 26 with an approximately 3 mm separation or recess 28, and a central pin 34. The embodiment also comprises seventy-five individual, randomly positioned pivot elements 32.

The number of rows of the wave-like wall elements 42 and 44 located in the heel portion of the device 12 can range from about twelve to about twenty rows. More typically there are about seventeen rows, defining there between about sixteen wave-like channels 46.

The massage mechanism is based on the reflexology science, wherein each point of the sole device represents an area of the body. During walking, pressure is exerted and thus provides the massage of specific and well-defined areas. It is a known fact that foot massage is beneficial to stimulate and increase blood circulation, which sometimes can be unsatisfactory in peripheral joints of the body, especially in the feet, particularly when enclosed by footwear. This is particularly the case during working situations, where a person may be in continuous movement during many hours of the day, and in other cases, is more or less motionless. The plurality of first projections can be positioned on the upper surface whereby the projections are uniformly distributed, or are positioned in groups of projections according to the reflex points located in the sole of a user's foot.

The elastomeric material of the shock-absorbing device is typically vapor pervious, comprising a plurality of microscopic orifices or pores (not shown), which allow vaporous exudates such as moisture and air to pass therethrough and between the lower surface 20 to the upper surface 18. The device 12 is internally designed such that a plurality of conduits are formed represented by the recesses 28 and other microscopic openings between the projections 22 and the pivots 32, as well as the wavy channels 46, creating an air chamber between the upper surface 18 and the bottom of the user's foot. The air chamber can accumulate, retain and transfer the vaporous exudates. The contained exudates can then dissipate to the outer surface of the footwear through the vapor pervious base 16. This improves the breathability and comfort of the footwear comprising the shock-absorbing device 12.

The shock-absorbing system and device 12 can be made of rubber or other materials, such as polyurethane, TR with salp, TR with polyurethane, TR and TR with sole, where TR means thermoplastic rubber, a relatively new synthetic rubber, which combines the good properties of vulcanized rubber with the processing advantages of thermoplastics, such as polyurethane.

By applying the suitable composition in the manufacturing of the device, it is possible to balance the elasticity of the used material with that of the movement of the foot.

In the final assembling of the footwear, and in order to achieve a greater comfort for the foot, an intermediate layer (not shown) can be placed onto the upper surface 18, between the device 12 and the shoe upper 14. The intermediate layer can be made of natural materials such as carbon, felt or cotton.

The shock-absorbing device and system of the instant invention can be used in a footwear article to not only provide an elastic cushioning and suitable support for the foot, but further to provide a foot massage on continually changing points on the foot, the footwear being lighter as well as more economical to produce or to manufacture.

The instant invention is based on the achieving of a uniform and suitable massage of the foot sole, since the defined profile of the upper, first projections in mechanical communication with the lower, second projections, closely correspond to the profile of the sole of the foot, such that not only the central part of the foot is supported by the projections, but also the side or marginal portions thereof.

It should be considered that the specification as well as the set of claims describes a preferred embodiment of the shock-absorbing device and the footwear article of the invention. It is possible, however, to introduce obvious modifications thereof, including different heights of the projections, dimensions, quantity, and designs both of the upper projections and the lower projections, without departing form the spirit and the scope of the invention, according to the following claims.

What is claimed is:

1. A shock-absorbing device for use in footwear, comprising 1) a base having an upper surface adapted to confront the bottom surface of a user's foot, and a lower surface adapted to contact a walking surface;

2) a plurality of first projections distributed on and upward from the upper surface, and projecting a normal direction to the bottom surface of the foot;

3) a plurality of second projections distributed on and projecting downward from the lower surface; and 4) a heel portion comprising a plurality of laterally-aligned and flexible, upright wall elements having a wave configuration spaced apart by a plurality of laterally-aligned channels having a wave configuration;

wherein the device provides a shock-absorbing system that is activated by the pressure exerted by foot flexion during walking on a walking surface, whereby the first projections are pressed in contact with the bottom of the foot.

2. The shock-absorbing device according to claim 1, wherein the first projections are distributed in positions corresponding to the reflex points located in the sole of the foot.

3. The shock-absorbing device according to claim 1, wherein the first projections have flexibility in a plurality of directions.

4. The shock-absorbing device according to claim 3, wherein the first projection comprises a plurality of raised members separated by a recess, and a central pin, and the second projection further comprises a circumferential recess at the periphery of the second projection that permits elastic movement of the second projection relative to the base in response to an upward displacement of the second projection.

5. The shock-absorbing device according to claim 1, further comprising a plurality of randomly-positioned pivot elements.

6. The shock-absorbing device according to claim 1, wherein the shock-absorbing device is made from a flexible material.

7. The shock-absorbing device according to claim 6, wherein the flexible material is vapor pervious.

8. The shock-absorbing device according to claim 6, wherein the flexible material is natural or synthetic rubber.

9. A footwear article, comprising:

a) a shock-absorbing device for use in footwear, comprising:

1) a base having an upper surface adapted to confront the bottom surface of a user's foot, and a lower surface adapted to confront the bottom surface of a user's foot, and a lower surface adapted to contact a walking surface, 2) a plurality of first projections distributed on and projecting upward from the upper surface, and projecting in a normal direction to the bottom surface of the foot, wherein the first projections comprise a plurality of raised members separated by a recess, and a central pin, and the second projection further comprises a circumferential recess that permits elastic movement of the second projection relative to the base in response to an upward displacement of the second projection, and 3) a plurality of second projections distributed on and projecting downward from the lower surface; wherein the device provides a shock-absorbing system that is activated by the pressure exerted by foot flexion during walking on a walking surface, whereby the first projections are pressed in contact with the bottom of the foot; and b) a shoe upper.

10. The footwear article according to claim 9 wherein the first projections are distributed in positions corresponding to the reflex points located in the sole of the foot.

11. The shock-absorbing device according to claim 9, further comprising a plurality of randomly-positioned pivot elements.

12. The shock-absorbing device according to claim 9, wherein the shock-absorbing device is made from a flexible material.

13. The shock-absorbing device according to claim 12, wherein the flexible material is vapor pervious.

14. A shock-absorbing system for footwear, comprising 1) a base having an upper surface and a lower surface, 2) a plurality of first projections distributed on and projecting upwardly from the upper surface, and in contact with and extending substantially in the normal direction to the bottom surface of a user's foot, and 3) a plurality of second projections distributed on and projecting downwardly from the lower surface, and in contact with a walking surface, the second projections having a shape, and a circumferential recess at the periphery of the second projection, wherein the shock-absorbing system is activated by pressure exerted on the second projections that, on foot flexion during stepping on the walking surface, cause the second projections to yield elastically and to displace relative to the base and press the first projections into contact with the bottom of the user's foot, thereby achieving a massage action, the shock-absorbing, and the uniform distribution of weight on the foot.

15. The shock-absorbing system according to claim 14, further comprising a plurality of upright wall elements having a wave configuration in a heel portion of the upper surface, having a shape and a cross section that allow flexion and torsion of the foot in the heel portion, following the shape of the walking surface.

16. The shock-absorbing system according to claim 14, wherein the first projections are uniformly distributed positioned on the upper surface.

17. The shock-absorbing system according to claim 14, wherein the first projections are positioned on the upper surface in groups of projections according to the reflex points located in the sole of a user's foot.

18. The shock-absorbing system according to claim 14, wherein the second projections have the same size and geometric shape.

19. The shock-absorbing system according to claim 14, wherein the system is made from a flexible material that is vapor pervious.

20. The footwear article according to claim 14, further comprising a plurality of upright wall elements having a wave configuration projecting from the upper surface of a heel portion, spaced apart by a plurality of laterally-aligned channels having a wave configuration, wherein said upright wall elements comprise a plurality of first wall elements and a plurality of second wall elements that project further from the base than the first wall elements.

* * * * *

UNITED STATES PATENT AND TRADEMARK OFFICE

CERTIFICATE OF CORRECTION

PATENT NO. : 6,898,871 B1
DATED : May 31, 2005
INVENTOR(S) : Maria Laura Herman

It is certified that error appears in the above-identified patent and that said Letters Patent is hereby corrected as shown below:

Column 5,
Line 38, after the word "projecting", the word -- in -- should be inserted.

Signed and Sealed this

Sixteenth Day of August, 2005

JON W. DUDAS
*Director of the United States Patent and Trademark Office*